United States Patent [19]

Moriguchi et al.

[11] 4,442,878

[45] Apr. 17, 1984

[54] HAND-HELD POWER TOOL WITH A MECHANISM

[75] Inventors: Seki Moriguchi; Katsuo Koizumi; Sueji Nagayama, all of Katsuta, Japan

[73] Assignee: Hitachi Koki Company, Limited, Tokyo, Japan

[21] Appl. No.: 289,898

[22] Filed: Aug. 4, 1981

[30] Foreign Application Priority Data

Aug. 5, 1980 [JP] Japan ..... 55-107415

[51] Int. Cl.[3] ..... B27C 1/10

[52] U.S. Cl. ..... 145/4

[58] Field of Search ..... 145/4, 4.1, 4.2

[56] References Cited

U.S. PATENT DOCUMENTS

| | | | |
|---|---|---|---|
| 915,080 | 3/1909 | Dixson et al. | 145/4.2 |
| 1,087,068 | 2/1914 | Lueck | 145/4.1 |
| 1,236,611 | 8/1917 | Shields | 145/4.1 |
| 1,339,172 | 5/1920 | Dempsey | 145/4.1 |
| 1,415,949 | 5/1922 | Perelman | 145/4.1 |
| 1,452,493 | 4/1923 | Conner | 145/4.1 |
| 2,003,603 | 6/1935 | McKernan | 145/4.1 |
| 2,649,873 | 8/1953 | Reich et al. | 145/4 |
| 2,688,348 | 9/1954 | Sullivan | 145/4.1 |

FOREIGN PATENT DOCUMENTS

| | | | |
|---|---|---|---|
| 38522 | 4/1957 | Poland | 145/4 |
| 290380 | 8/1953 | Switzerland | 145/4 |
| 297502 | 6/1954 | Switzerland | 145/4.1 |

*Primary Examiner*—Frederick R. Schmidt
*Assistant Examiner*—J. T. Zatarga
*Attorney, Agent, or Firm*—Lowe, King, Price & Becker

[57] ABSTRACT

A hand-held power tool, such as an electric planer or the like, comprises a mechanism for moving or forwarding the body of the tool in a straight hand path. The mechanism includes a rotary wheel or a plate attached to the tool body so that the rotary wheel or plate contacts the surface of a work piece when the tool body is placed thereon. The rotary wheel or the plate is made of a material having a high friction coefficient. A plurality of parallel grooves are formed on the surface of the rotary wheel or so that a high degree of friction occurs between the surface thereof and the surface of the work piece should the body move in a direction other than a given direction on the surface of the work piece. The rotary wheel or plate is biased toward the work piece with the biasing force applied to the rotary wheel being variable.

13 Claims, 9 Drawing Figures

HAND-HELD POWER TOOL WITH A MECHANISM

BACKGROUND OF THE INVENTION

This invention relates generally to hand-held power tools, such as an electric planer, groover, jigsaw, router, trimmer, circular saw, cut-off machine and the like, having a slide base in contact with a surface of a work piece. More particularly, the present invention relates to a mechanism for guiding the tool body so as to travel straight with respect to the work piece.

When machining a work piece, such as a piece or board of wood, metal and concrete, with a hand-held power tool, it is important that the tool body moves straight along the surface of the work piece. For instance, if a planer is not moved straight, the blade thereof travels along a curve, machining the work piece in an undesirable manner. Namely, the blade of the tool is apt to slip off a given range on the surface of the work piece, and thus a portion of the surface of the work piece may be left unmachined. Furthermore, in the case of a groover or the like, the machined groove is apt to be undesirably curved due to nonstraight forwarding of the total.

Some conventional hand held tools are equipped with a guide piece for guiding the tool body parallel to the side of the work piece. However, attachment of the guide piece is troublesome. Also, entire tool including the guide piece is bulky and therefore often difficult to handle. Furthermore, when the size of the work piece is large, such a guide piece cannot be used. In addition, since such conventional guide pieces are arranged to be in contact with only one side of a work piece, the hand-held power tool equipped with the guide has to be moved by applying a force whose direction is slightly deviated from the straight forwarding direction so that the guide piece is always in contact with the side of the work piece.

For these reasons, such a conventional guide piece has not been used very much hitherto. Therefore, the user or operator of such a tool has to be very careful so that the tool slides straight on the surface of the work piece.

SUMMARY OF THE INVENTION

This invention has been developed in order to remove the above-mentioned disadvantages and drawbacks inherent to the conventional hand-held power tools.

It is, therefore, a primary object of the present invention to provide a new and useful hand-held power tool with a mechanism for straight forwarding so that the body of the tool can travel straight without using a guide member arranged to slide along the side of a work piece to be machined.

Another object of the present invention is to provide a hand-held power tool with the straight forwarding mechanism which is small in size and simple in construction.

In accordance with the present invention there is provided a hand-held power tool with a mechanism for straight forwarding, comprising: a body having at least one slide base arranged to be placed on the surface of a work piece to be machined, a blade, a blade driving mechanism, and a housing for containing therein the blade and the blade driving mechanism; and a mechanism attached to the body for producing a relatively high degree of friction with respect to the surface of the work piece when the body tends to travel in a direction other than a given direction on the surface of the work piece.

BRIEF DESCRIPTION OF THE DRAWINGS

These and other objects and features of the present invention will become more readily apparent from the following detailed description of the preferred embodiments taken in conjunction with the accompanying drawings in which.

The same or corresponding elements and parts are designated at like numerals throughout the drawings.

DETAILED DESCRIPTION OF THE INVENTION

Prior to describing the preferred embodiments of the present invention, the aforementioned disadvantages inherent to the conventional hand-held power tool will be described with reference to FIGS. 1 and 2 for a better understanding of the objects of the present invention.

Figure 1:
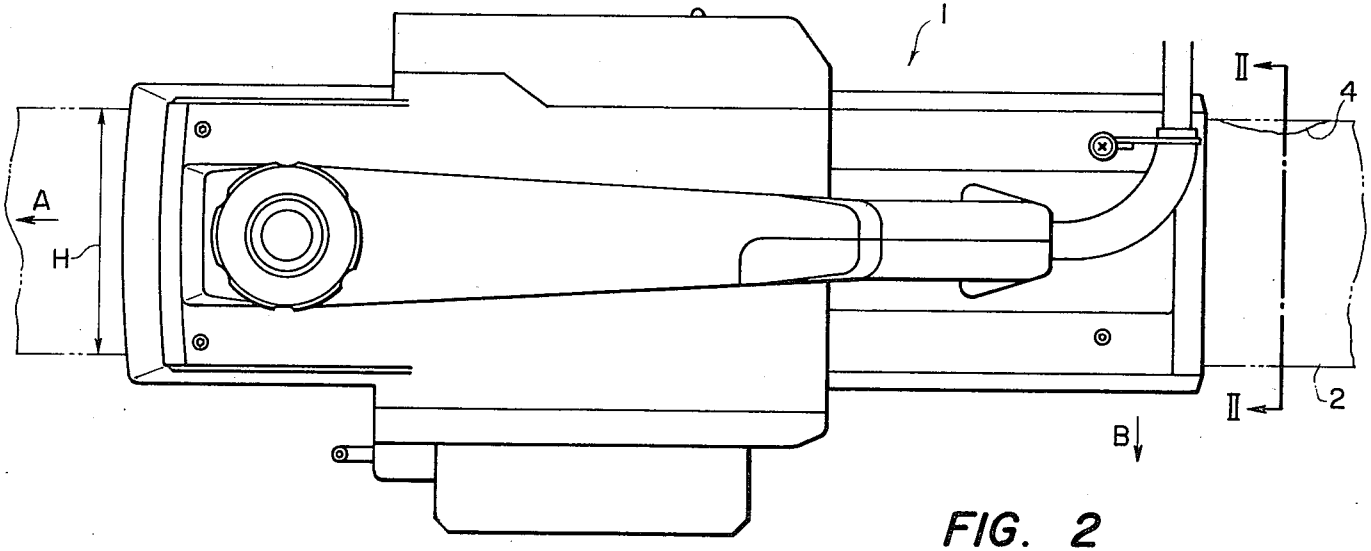
FIG. 1 is a schematic top plan view of a conventional electric planer.
Figure 2:
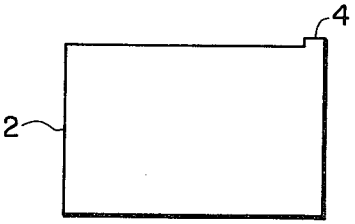
FIG. 2 is a cross-sectional view of a work piece machined by the conventional electric planer of FIG. 1.

FIG. 1 is a top plan view of a conventional electric planer whose body is generally designated by reference numeral 1. The planer body 1 is shown to be placed on a work piece 2 to be machined. The width of work piece 2 is indicated by reference H. It is assumed that the width of the blade (not shown) of the planer is equal to or a little greater than the width H of the work piece 2. In order to machine the surface of work piece 2 in longitudinal direction A, it is necessary to forward the planer in the same direction, which corresponds to the longitudinal direction of the planer body 1. However, since planer body 1 is moved along the surface of work piece 2 by applying a forward force by one or both hands of a user, the forward force is not necessarily applied to the planer body in the direction A. As a result, the forwarding direction is apt to deviate, causing planer body 1 to travel in a direction other than straight direction A which is parallel to the sides of work piece 2. Assuming that the forwarding direction of planer body 1 has deviated from straight direction A in a direction indicated by an arrow B, the upper surface of work piece 2 is not entirely covered by the blade, causing a portion 4 of the upper surface of the work piece 2 to remain unmachined as shown in of FIG. 2.

Figure 3:
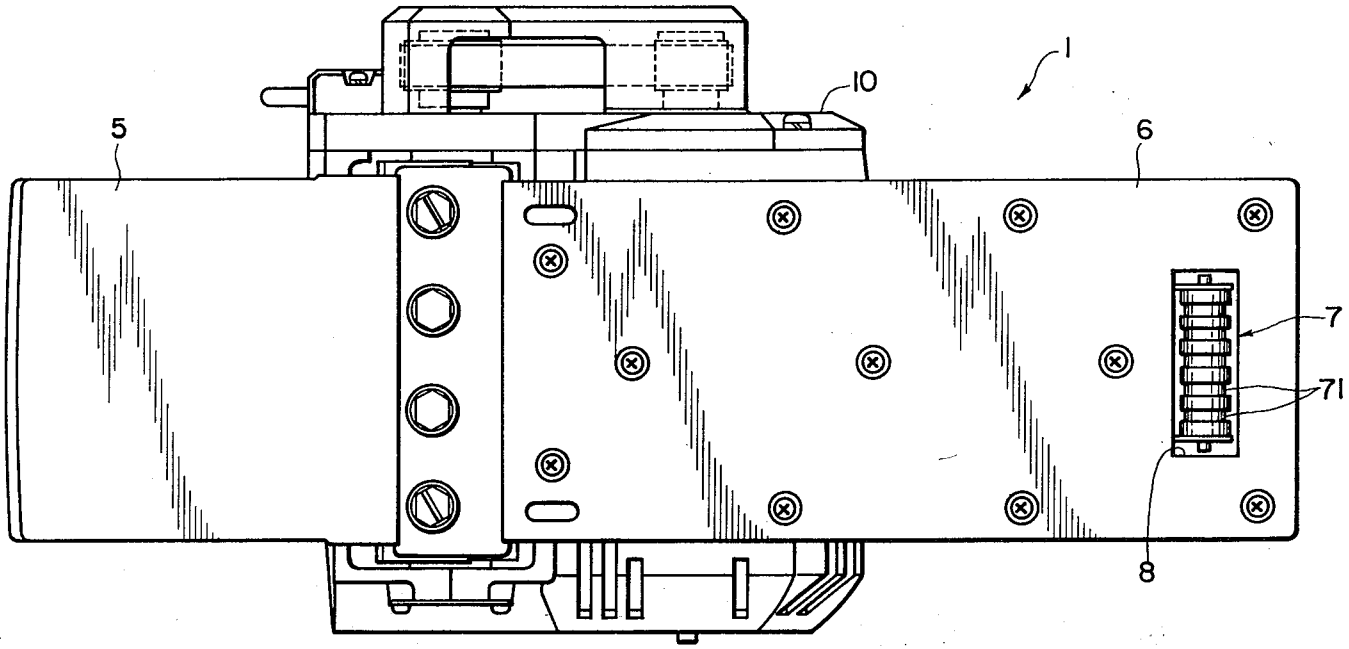
FIG. 3 is a schematic bottom plan view of a first embodiment of the present invention.
Figure 4:
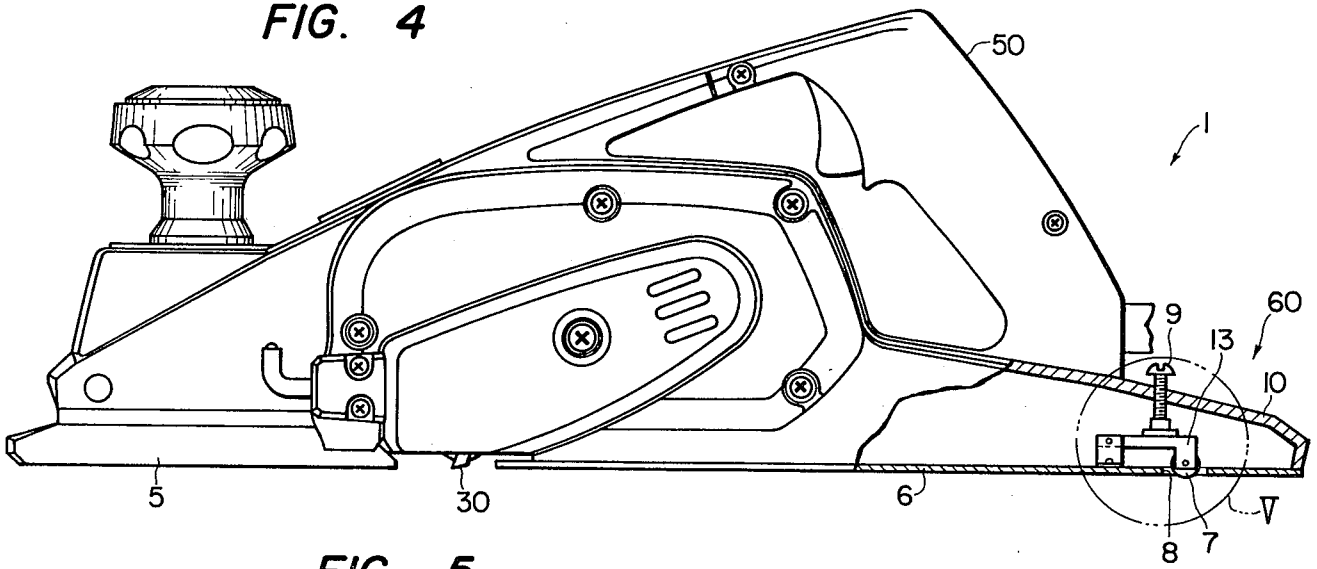
FIG. 4 is a schematic partial cross-sectional side view of the electric planer of FIG. 3.

Referring now to FIG. 3 a bottom plan view of a first embodiment of the present invention is shown. Not only the first embodiment but also the following embodiments will be described in connection with an electric planer. The first embodiment, which is shown in the form of a planer, is also shown in FIG. 4 by way of a partial cross-sectional view. The body of the planer is generally designated at a reference numeral 1, and the planer body 1 comprises first and second slide bases 5 and 6 at a bottom thereof, a rotary blade 30, a housing 10 and a hand grip 50. The rotary blade 30 is arranged to be rotated by means of a driving mechanism received in housing 10 in the same manner as in the conventional power tools.

Figure 5:
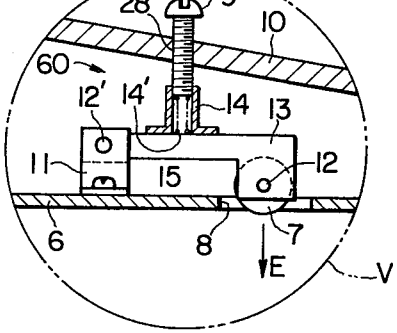
FIG. 5 is an enlarged cross-sectional view showing the detailed structure of the straight forwarding mechanism attached to the body of the handy electric planer of FIG. 4.

The planer of FIGS. 3 and 4 differs from the conventional one in that a straight forwarding mechanism 60 is additionally provided. As shown in FIGS. 3 and 4, a rotary wheel 7 is rotatably received in housing 10 in such a manner that a portion of the rotary wheel projects downwardly below the lower or outer surface of second slide base 6 through a rectangular opening 8. The structure of straight forwarding mechanism 60 is best seen in an enlarged view of FIG. 5 showing a circled portion V of FIG. 4. Rotary wheel 7 is rotatably supported by means of a shaft 12 connected to one end of an L-shaped arm 13. The other end of L-shaped arm 13 is rotatably attached by means of a shaft 12' to a stand 11 secured by a screw or screws 15 to the inner surface of second slide base 6.

A cylindrical holder 14 is securely attached or integrally formed with the L-shaped arm 13 in such a manner that the cylindrical holder is substantially perpendicular to the second slide base 6 when the longitudinal direction of the L-shaped arm is substantially parallel to the second slide base. A coil spring 14' is received in the bore of cylindrical holder 14 to receive the tip portion of an adjusting screw 9 threaded into screw hole 28 in housing 10. With this arrangement, L-shaped arm 13 is biased downward FIG. 5, and the biasing force may be changed by adjusting the position of adjusting screw 9. As a result, when planerbody 1 is not placed on a work piece, rotary wheel 7 projects outside through opening 8 in a direction indicated by arrow E. On the other hand, when planer body 1 is placed on the surface of a work piece (not shown), rotary wheel 7 receives an upward force from the work piece surface, causing L-shaped arm 13 pivot counterclockwise against the force of spring 14' due to the weight of the planer body so that rotary wheel 7 is positioned above the lower or outer surface of second slide base 6. Rotary wheel 7, which is made of a deformable material, such as rubber, is thereby deformed when engaging of the work piece surface.

Figure 6:
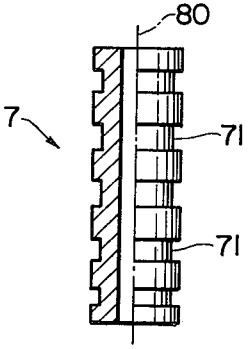
FIG. 6 is a schematic partial cross-sectional view of a rotary wheel of the straight forwarding mechanism of FIG. 5.

FIG. 6 shows a partial cross-sectional view of rotary wheel 7 which has a width relatively greater than the diameter thereof, and a plurality of annular grooves 71 formed along the periphery. Annular grooves 71 are parallel to each other and perpendicular to the center shaft 80 which corresponds to the center of rotation. Rotary wheel 7 is made of a material having a relatively high friction coefficient. In this embodiment, the rotary wheel 7 is made of rubber. If desired, a synthetic resin may be used.

The first embodiment operates as follows. When planer body 1 is moved in the longitudinal direction along the surface of a work piece, rotary wheel 7 rotates due to contact with the work piece surface to be machined. Because rotary wheel 7 rotates, it does not receive a large amount of friction as long as body 1 of the planer is moved straight, i.e. in the longitudinal direction of the planer body. However, should body 1 tend to move or travel in a direction other than the longitudinal direction, rotary wheel 7 receives a relatively high degree of frictional force from the surface of the work piece. As a result, body 1 is prevented from travelling along an undesirable curved path even if a forwarding force applied from the operator's hand or hands is not perfectly straight. Consequently, planer body 1 moves straight along a given straight line which corresponding to the longitudinal axis of the planer body 1.

Furthermore, if the surface of the work piece to be machined is not flat, rotary wheel 7 is capable of projecting below the lower surface of second slide base 6 to remain in contact with the work piece surface. Accordingly, friction occurs to prevent planer body 1 from moving in an undesired direction.

From the above, it will be understood that planer body 1 is capable of travelling straight without transverse movement due to straight forwarding mechanism 60.

Figure 7:
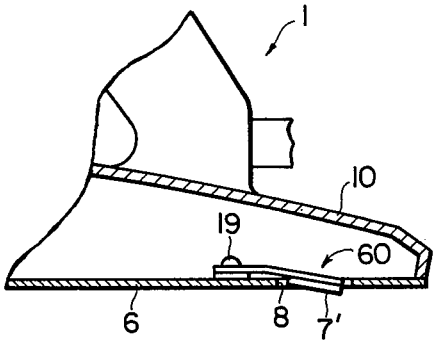
FIG. 7 is a partial cross-sectional side view of a second embodiment of the present invention.
Figure 8:
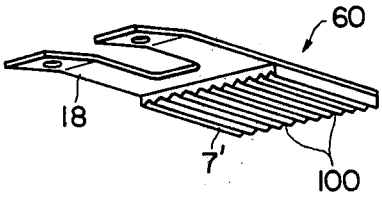
FIG. 8 is perspective view of a contact member used for the second embodiment of FIG. 7.

Reference is now made to FIGS. 7 and 8 which show a second embodiment of the present invention. The second embodiment differs from the above-described first embodiment in that the straight forwarding mechanism, which is also designated by reference numeral 60, comprises a stationary member in place of rotary wheel 7. FIG. 7 shows only a portion of an electric planer of the second embodiment, while FIG. 8 shows an enlarged perspective view of the above-mentioned stationary member 7'.

The straight forwarding mechanism 60 of the second embodiment further comprises an attachment plate 18 made of elastic material. Stationary member 7' will be referred to as a contact piece, and is made of a material having a relatively high friction coefficient. Contact piece 7' has a rectangular shape in this embodiment, and is made of rubber or the like. Attachment plate 18 is fixed to the inner surface of second slide base 6 by screws 19, as shown in FIG. 7. Contact piece 7' is attached at one side thereof, to the lower surface of attachment plate 18, and has an undulatory surface on the other side as shown in FIG. 8. In detail, a plurality of parallel grooves 100 provide the undulatory surface, where the direction of the grooves corresponds to the longitudinal or forwarding direction of body 1. Attachment plate 18 is made of elastic material, such as a leaf spring or a synthetic resin, as described above, so that contact piece 7' can move upward in receipt of an upward force when the planer body is placed on a work piece in the same manner as described in connection with the first embodiment.

The above-described second embodiment operates in a manner similar to the first embodiment. Namely, when planer body 1 is placed on a work piece, contact piece 7' is depressed by the surface of the work piece which is the objective of machining against the downward force of attachment plate 18. Since contact piece 7' is biased downwardly by the force of attachment plate 18, i.e. toward the work piece, the undulatory lower surface of the contact piece abuts against the work piece surface. When planer body 1 moves in a given forwarding direction, contact piece 7' receives a negligibly small friction because of parallel grooves 100. On the other hand, when planer body 1 receives a force whose direction is other than the straight forwarding direction, a relatively high degree of friction occurs between the surface of the work piece and the lower surface of contact piece 7'. Accordingly, planer body 1 moves straight in the same manner as in the first embodiment.

Experimentation shows that the hand-held power tool according to the present invention moves straight as compared to the conventional tools having no straight forwarding mechanism. The results of the experiments will be described with reference to a diagram of FIG. 9.

Figure 9:
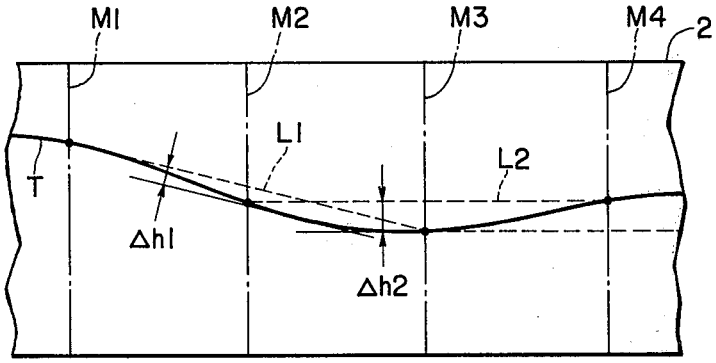
FIG. 9 is an explanatory diagram showing the way of amount of transverse swing of the tool.

FIG. 9 shows an upper surface of a work piece, such as piece of wood, to be machined. A pen (not shown) is attached, in the vicinity of the rotary wheel 7 of the above-described first embodiment tool so that trace of the machining portion will be ascertained on the work piece after machining.

First, a work piece is machined by a conventional handy electric planer, and then another work piece is machined by the first embodiment planer. After machining, a plurality of mark lines M1, M2, M3 . . . (see dot-dash lines) are drawn equidistantly in parallel on the machined surfaces of the work pieces. The mark lines are substantially perpendicular to the sides of the respective work pieces. Then a point of intersection of the first mark line M1 and the trace T is connected by a line L1 (see the left-most dotted line) to a point of intersection of the third mark line M3 and the trace T. Then the maximum distance Δh1 between the line L1 and the trace T is obtained. Next, a second maximum distance Δh2 between a second line L2 and the trace T between the second and fourth mark lines M2 and M4 is obtained in the same manner. In this way following maximum distances Δh3, Δh4 . . . Δhn are obtained. After all maximum distances Δh1 to Δhn have been obtained, the sum thereof, which is given by the following formula, is obtained.

$$\Sigma\Delta h=\Delta h1+\Delta h2+\ldots+\Delta hn$$

In the above experiments, the value of "n" is set to 9, while the distance between adjacent mark lines M1 to Mn is set to 100 millimeter.

The value of ΣΔh obtained from the above formula is used for evaluating the degree of transverse swing of the hand-held tool. Accordingly, the results of the experiments are obtained as shown in the following table.

| | WITH A CONVENTIONAL ELECTRIC PLANNER | WITH THE FIRST EMBODIMENT ELECTRIC PLANNER |
|---|---|---|
| ΣΔH | 37 mm | 4.3 mm |

From the comparison between the values of ΣΔh, it will be understood that the hand-held power tool according to the present invention is effectively prevented from being moved in undesirable directions. Although the above results of the experiments is of the first embodiment of the present invention, the second and following embodiments also function in a similar manner providing similar results.

From the foregoing description, it will be understood that according to the present invention rotary or nonrotary friction member or members is provided to the body 1 of the hand-held power tool, where friction between the friction member(s) and the surface of a work piece is much higher in the transverse direction of the body 1 of the tool than that in the longitudinal direction thereof. With the provision of such means for forwarding the body of the tool in a desired straight direction, the hand-held tool can be moved straight as proofed by the experiments described in the above.

The above-described embodiments are just examples of the present invention, and therefore, it will be apparent for those skilled in the art that many modifications and variations may be made without departing from the spirit of the present invention.

What is claimed is:

1. A hand-held power tool with a mechanism for straight forwarding, comprising:
   (a) a body having at least one slide base arranged to be positioned on and contact a surface of a work piece to be machined, a blade, a blade driving mechanism, and a housing containing therein said blade and said blade driving mechanism; and
   (b) a mechanism attached to said body for producing a high degree of friction with respect to the surface of said work piece when said body tends to travel in a direction other than a given direction on the surface of said work piece, said mechanism having a friction member arranged to contact said work piece, and biasing means connected between said body and said friction member such that a portion of said friction member projects outside beyond said slide base when said slide base is not in contact with the surface of said work piece, said friction member being depressed upwardly when said slide base is placed on the surface of said work piece, said biasing means being sufficiently elastic so that said friction member is pressed into contact with the surface of said work piece when said slide base is placed on the surface of in contact with said work piece.

2. A hand-held power tool with a mechanism for straight forwarding as claimed in claim 1, wherein said friction member includes a rotary wheel.

3. A hand-held power tool with a mechanism for straight forwarding as claimed in claim 1, wherein the friction member includes at least one plate having a plurality of substantially parallel grooves on one surface thereof adapted to contact the work piece surface.

4. A hand-held power tool with a mechanism for straight forwarding as claimed in claim 3, wherein said biasing means biases said plate in a given direction so that said plate projects beyond the lower surface of said slide base when no external force is applied to said plate.

5. A hand-held power tool with a mechanism for straight forwarding as claimed in claim 2, wherein said rotary wheel is made of a material having a high coefficient of friction.

6. A hand-held power tool with a mechanism for straight forwarding as claimed in claim 3, wherein said plate is made of a material having a high coefficient of friction.

7. A hand-held power tool with a mechanism for straight forwarding as claimed in claim 5 or 6, wherein said material is rubber.

8. A hand-held power tool with a mechanism for straight forwarding as claimed in claim 5 or 6, wherein said material is a synthetic resin.

9. A hand-held power tool with a mechanism for straight forwarding as claimed in claim 2, wherein a plurality of annular grooves are formed on the periphery of said rotary wheel.

10. A hand-held power tool with a mechanism for straight forwarding as claimed in claim 2, wherein said biasing means includes a rotatably attached arm to which said rotary wheel is rotatably attached, a coil spring operatively connected to said arm, and a member for stopping one end of said coil spring.

11. A hand-held power tool with a mechanism for straight forwarding as claimed in claim 1, wherein the biasing means includes a leaf spring attached at one end thereof to the body of said hand-held power tool.

12. A hand-held power tool with a mechanism for straight forwarding as claimed in claim 2, further comprising means for adjusting the biasing force of the biasing means.

13. A hand-held power tool with a mechanism for straight forwarding as claimed in claim 12, wherein the adjusting means comprises an adjusting screw engaging a screw hole formed in said housing.

* * * * *